United States Patent [19]

Blake, III

[11] Patent Number: 4,901,925

[45] Date of Patent: Feb. 20, 1990

[54] FOAM GENERATING DEVICE

[76] Inventor: Joseph W. Blake, III, 88 Main St., New Canaan, Conn. 06840

[21] Appl. No.: 57,037

[22] Filed: Jun. 2, 1987

[51] Int. Cl.[4] ..... B05B 7/32

[52] U.S. Cl. ..... 239/343; 222/189; 222/190; 239/346; 239/366; 239/370; 239/371; 239/417.3; 239/432

[58] Field of Search ..... 239/343, 346, 350, 366, 239/416.5, 417.3, 417.5, 432; 222/189, 190

[56] References Cited

U.S. PATENT DOCUMENTS

| | | | |
|---|---|---|---|
| 3,937,364 | 2/1976 | Wright | 239/343 |
| 4,022,351 | 5/1977 | Wright | 222/190 |
| 4,044,923 | 8/1977 | Gardner | 239/343 |
| 4,531,659 | 7/1985 | Wright | 222/190 |
| 4,531,660 | 7/1985 | Ford, Jr. | 222/209 |

*Primary Examiner*—Andres Kashnikow
*Assistant Examiner*—Michael J. Forman
*Attorney, Agent, or Firm*—Seymour G. Bekelnitzky

[57] ABSTRACT

An article for generating foams from foamable liquids and pressurized gases comprising a housing encompassing a hollow porous element in fluid connection with the gas source through an inlet port in the housing, a mixing chamber comprising the space between the walls of the porous element and housing in fluid connection a source of the foamable liquid wherein the liquid and the gas diffusing thereto through the wall of the element mix to form the foam which is discharged without passing through pores the article further comprising, if desired, a valve to prevent entry of the gas to the porous element, and therethrough to mix with the liquid, whereby the liquid is dispensed in its liquid form.

14 Claims, 3 Drawing Sheets

FIG. 6a
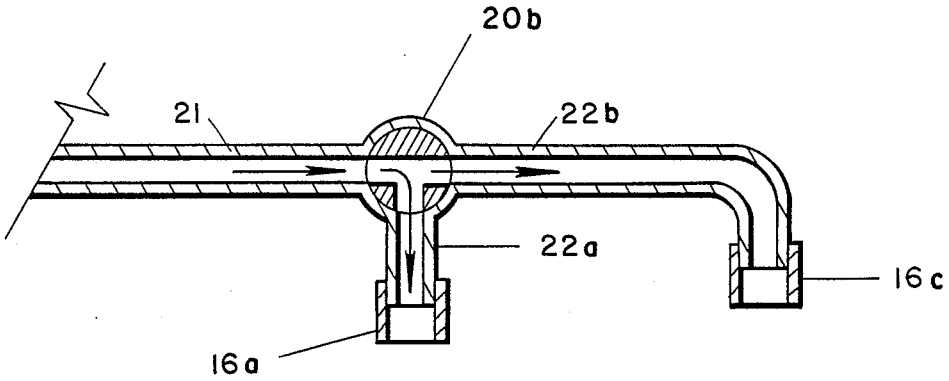
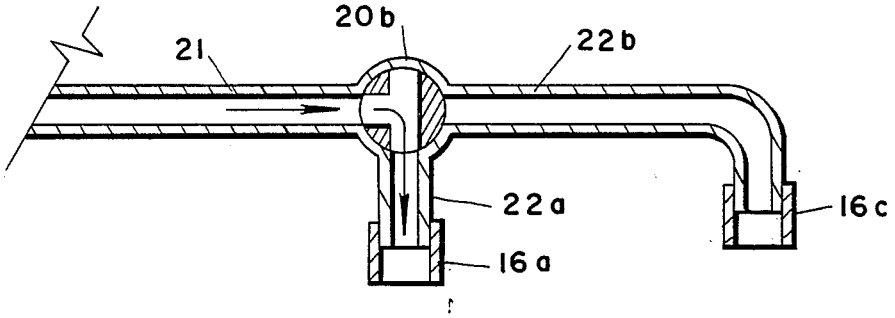
FIG. 6b

FOAM GENERATING DEVICE

BACKGROUND OF THE INVENTION

This invention relates to foam dispensing devices and more particularly to foam producing devices for use with fluids which tend to clog the pores of conventional foam dispensing devices said devices also permitting the dispensing, if desired, of the fluid as a liquid rather than a foam.

Numerous foam dispensing devices of a non-aerosol type, which are essentially hand held squeeze bottles of relatively small capacity, have been described in, e.g., U.S. Pat. Nos. 3,709,437 and 3,937,364. However, their characteristics cannot be extrapolated to devices of economically desirable large capacity. This is due to the fact that pressure and liquid capacity control is difficult to achieve in view of the small size required in the foam producing means to produce the most desired foams.

U.S. Pat. No. 4,531,660 describes a device intended to overcome the above disadvantages by placing a small inner chamber, associated with the foam producing means, said combination maximizing the foam quality, within a large chamber or reservoir of economically desirable large capacity.

However, said devices suffer from the disadvantage, by virtue of the foam outlet means being part of the foam producing means must precede it with the concomitant result, that with certain fluids, such as Povidone TM, the pores of the foam producing means are ultimately clogged. This is a consequence of the foams (i.e., the foamable liquid and gas) having to pass through the pores of the foam producing means.

In addition, as the foam producing means are inserted within the mouth of the foam dispensing device it is necessary to package the foamable liquid and foam producing means as a single unit whereby portability and versatility are descreased.

It is believed, although the theory is not essential to the practice of the invention, that fluids, such as Povidone TM, which are based on polymeric materials, clog the pores of the foaming means by separation and buildup of the polymeric moieties upstream of and/or within the pores.

It is to be understood throughout the application that references to air and gas may be used interchangably and that the term gas refers to inert gases such as nitrogen.

Furthermore, the described invention makes no provision for dispensing the foamable liquid in a liquid form, if desired, as an alternative to the foam form.

The instant invention to the contrary obviates the above difficulties in that the mixing of the foamable liquid and gas occurs only outside of the container, or reservoir and outside (i.e., downstream) of the pores of the foam producing means. Thus, only the foam producing gas passes through the pores of the foam producing means, when desired, to mix with the foamable liquids to form foams which do not pass through any porous materials after formation.

It is to be understood throughout the application that references to air and gas may be used interchangably and that the term gas refers to inert gases such as nitrogen.

SUMMARY OF THE INVENTION

An object of the invention is to provide foam dispensing device for the alternative dispensing of either foams or liquids.

Another object of the invention is to provide means of producing foams in said foam dispensing device without clogging of the pores of the porous element of the foam producing means.

According to yet another object of the invention there is provided liquid delivery means in which a large outer container, for holding liquid, having a discharge port, an inner container disposed within said outer container and in liquid connection therewith through a port; a closure for said inner container having pressurized air inlet means and foamable liquid outlet means; a tube descending vertically from said closure in liquid communication with the liquid outlet means having an opening at its lower end to provide liquid communication with said inner container; one-way valve means in the inner container to close the port between the inner and outer containers when pressure within the inner container is increased to supply liquid through said liquid outlet means to the foam producing means and to open said port to permit flow of liquid from the outer container to the inner container when pressure in the inner container is decreased.

It is another aspect of the invention to provide foam producing means which are external to both the inner and outer containers.

Yet another object of the invention is to provide means to alternatively generate foams or dispense unfoamed liquids comprising a porous element a partially gas permeable wall, a gas distributing plenum a gas entry port in fluid connection with said plenum; a second wall opposite the outer surface of said gas permeable wall; a mixing chamber comprising at one end, the proximal end, a small annular opening between said gas permeable and second wall, comprising an orifice for the uniform distribution of foamable liquids therethrough into said chamber and at the distal end an exit port for the discharge of foams or liquids from said chamber said chamber being tapered or not, as required; a liquid distribution plenum for the uniform distribution of said foamable liquids to said orifice and a liquid entry port in fluid connection, through a conduit with said plenum wherein said plenum and a source of foamable liquid are in fluid connection through a conduit therebetween; with the proviso that only the portion of said gas permeable wall between said orifice and said exit port is gas permeable said device further comprising, in the conduit between said pressurized gas source and said gas distributing plenum valve means to prevent entrance of said gas to said device when only the dispensing of liquid is desired.

Another aspect of the invention is to provide valve means to prevent entrance of said gas into said porous element when only dispensing of liquid is desired.

Yet another aspect of the invention is to provide a squeeze bottle type of foam dispensing device comprising a container, or reservoir, for foamable liquid, comprising a semi-rigid container comprising at one end a discharge port, to supply foamable liquid to the foam producing means which can dispense said foamable liquid in the form of foam or liquid, alternatively.

Accordingly to this aspect there is provided foam producing means comprising a housing comprising a base comprising air and liquid inlet ports; a porous element comprising a partially porous wall and an air inlet port in fluid connection with the air inlet port of said base; a fluid distribution base, into which the base of the housing may be rotatably inserted, comprising air and liquid outlet ports, and a hollow tube, or conduit, descending vertically therefrom in fluid connection with said air outlet port the opposite end being sealed by a one-way valve which opens upon inversion of the outer container of the foam dispensing device and application of pressure thereto, for passage of air therethrough, and, if desired, into said porous element said valve closing, upon release of pressure to the outer container, with a concomitant decrease of pressure therein, and reinversion thereof, to prevent flow of liquid and/or air into said conduit; the base of said housing being partially rotatable within said distribution base to permit aligning of all of the liquid transmission ports when only dispensing of liquid is desired, aligning of both the liquid and air transmission ports when generation and dispensing of foams is desired and aligning none of said ports when no dispensing is desired.

The foamable liquid reservoir comprises at one end a discharge port into which the foam producing means is inserted and held in place by a cap having internal threads matched to the external threads of the neck of said reservoir or other retaining means known to the art.

BRIEF DESCRIPTION OF THE DRAWINGS

FIG. 6 is an elevational sectional view of an alternate gas valving system for the foam dispensing device of FIG. 1.

DETAILED DESCRIPTION OF THE PREFERRED EMBODIMENT

Figure 1:
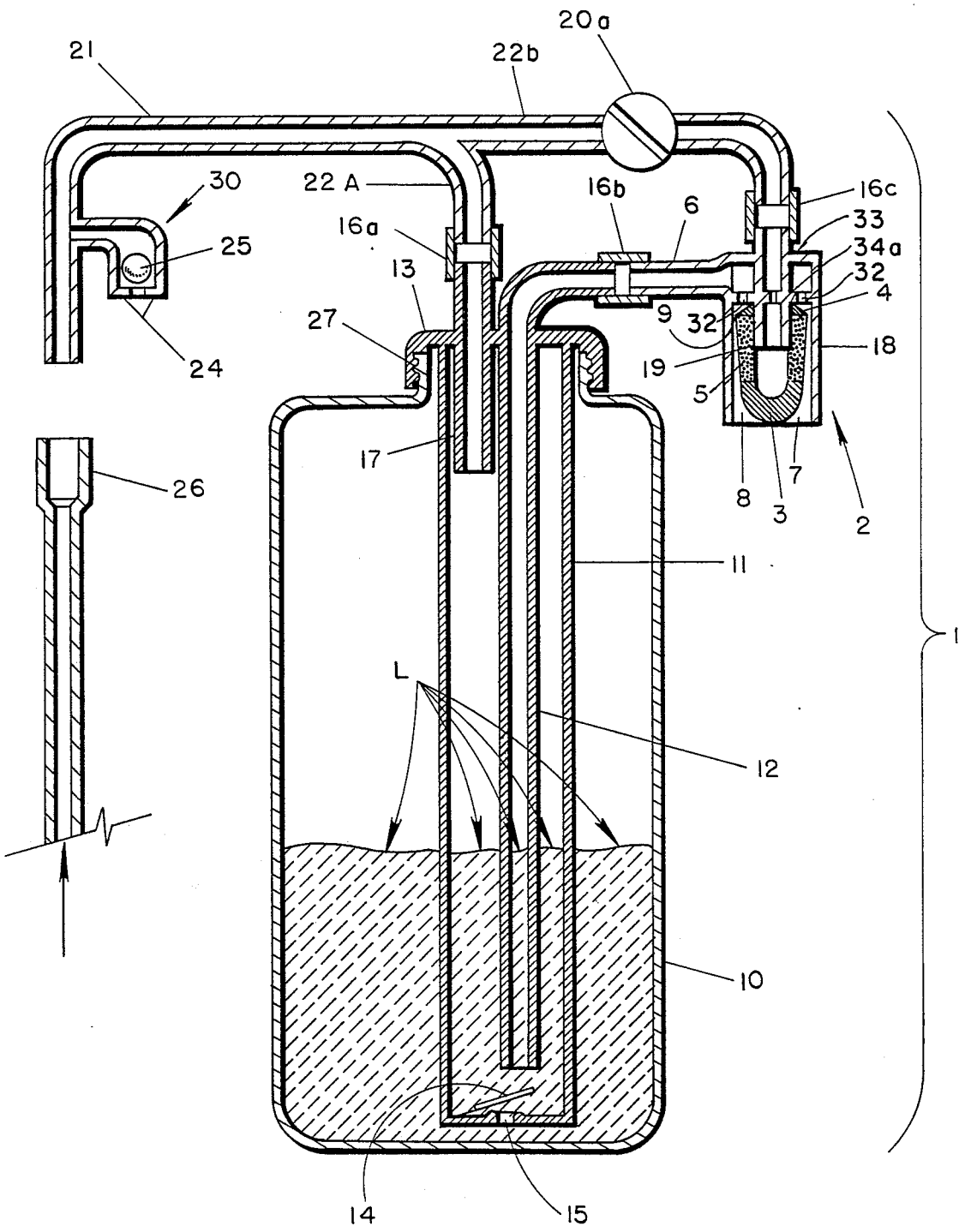
FIG. 1 is an elevational sectional view of the foam dispensing device of the invention.

Referring now to FIGS. 1–5 there is described a foam dispensing device which is generally indicated by 1 comprising an outer container 10 having a neck 27 which defines an exit port. The device also includes a cap 13, which may be affixed to the outer portion of said neck means by matched threads on the inner portion of the vertical wall of said cap and the outer wall of said neck or by any other means known to the art.

The outer container 10 provides a large reservoir of foamable liquid, L. and may be formed of any compatible rigid or non-rigid materials such as plastics, metals & glasses.

The cap also provides a tubular elemement 11 descending vertically therefrom and forming an inner container within said outer container which acts as a smaller auxiliary reservoir for the foamable liquid.

The cap 13 further comprises a gas inlet stem 17 passing therethrough for admission of pressurized air to the inner container and a tube 12 descending vertically from the bottom of said cap said tube having an opening at the bottom thereof for liquid connection to the inner container for transfer of foamable liquid from said inner container to the foam producing means upon application of pressurized air to the surface of said liquid L in the inner container 11.

The foam dispensing device further comprises foam producing means in fluid connection with said inner tube 12. Said foam producing means may be inserted in the neck of container 10 or external thereto.

Figure 2:
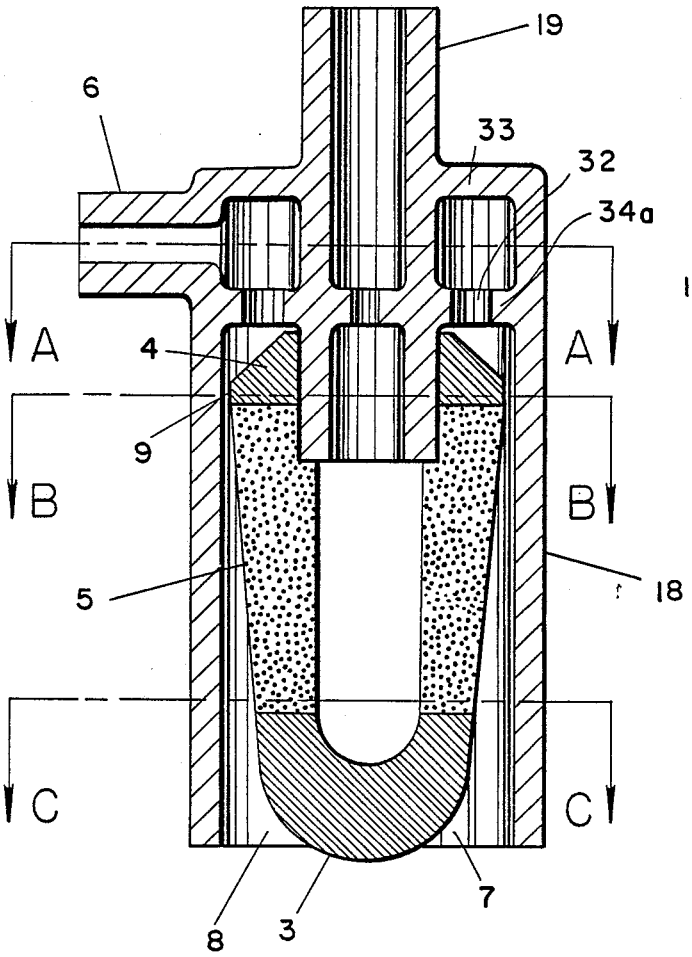
FIG. 2 is an elevational sectional view of the foam producing means of the invention.
Figure 3:
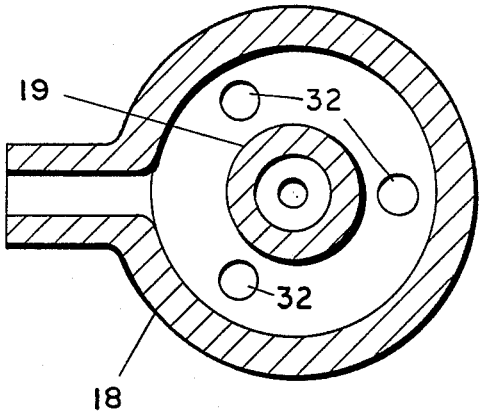
FIG. 3 is a cross-sectional view of the foam producing means along line A—A of FIG. 2.
Figure 4:
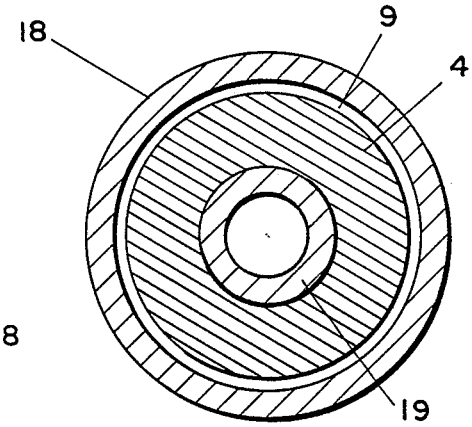
FIG. 4 is a cross-sectional view of the foam producing means along line B—B of FIG. 2.
Figure 5:
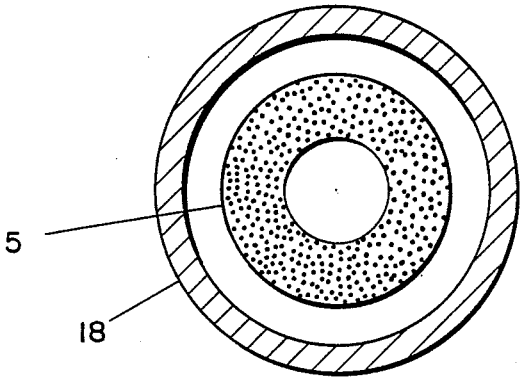
FIG. 5 is a cross-sectional view of the foam producing means along line C—C of FIG. 2.

As shown in FIGS. 2, 4 and 5 the foam producing means, generally indicated by the numeral 2 comprises a housing 18 comprising a porous element 7, and gas inlet means comprising a stem 19 passing through the upper 33 and inner 31 walls of said housing and into said porous element for the delivery of pressurized air thereto as required.

The wall of said porous element 7 flares outwardly from the inlet port thereto and the end opposite said inlet port to create a narrow annular space, or orifice 9, between said element and the inner wall of the housing. The portion 4 of the wall of the element between said orifice and the inlet port of the element as well as the portion 3 of the wall of the element extending from the other end towards said orifice are non-porous and air cannot diffuse through those portions of the element 7. The remainder 5 of said wall is porous. The porous portion of the wall may be chosen from materials well known in the art such as 70 um open celled polyethylene. The non-porous portions may be formed in any manner known in the art including painting and curing of an epoxy resin on a preformed porous wall in those areas where non-porosity is desired. Furthermore, if desired, the permeability of the porous portion may be limited to only gases and even to specific gases. The choice of materials and processes will be selected by the user in accordance with his requirements.

Said housing 18 further comprises fluid inlet means 6, positioned between the horizontal walls 31 and 33 of said housing, which is in fluid communication with the liquid outlet means 12 of the inner container 11 through connector **16*b* and with the space between said porous element and said housing wall 18 through liquid entry port 232 in inner horizontal wall 31** of said housing.

The dispensing device further comprises a dual branched pressurized air delivery tube 21 in fluid connection, at a first branch **22*b*, with inlet stem 19 through valve 20*a* and connector 16*c*. Said gas delivery tube is also in fluid connection, at a second branch 22*a*, with stem 17 through connector 16*a***.

Said tube 21 further comprises a one-way valve for return of air to the pressurized air source comprising a port 23 for admission of air to the tube 21, a valve seat 24 and a ball 25 whose diameter is greater than that of the valve seat.

It is, of course, understood that any one-way valve, known to the art may be used here.

Furthermore, as desired, other compatible pressurized gases, such as nitrogen, may be used in lieu of air as well as other means of relieving the pressure in tube 21 or for other applications where air is called for.

Fluid connection between tube 21 and the pressurized air source is provided by means of connector 26.

Said inner container 11 further comprises at its lower end a liquid entry port 15 and a flapper valve 14 which closes said port when the pressure within said inner container exceeds that in the outer container.

Thus, in the embodiment shown pressurized air is provided from any pressurized air source through tube 21 and inlet 17 to the inner container to force foamable liquid through delivery tube 12 to the foam producing means whence it passes through the small annular orifice 9 over the porous portion of element 7.

If foam is the desired product valve 20*a* is opened thereby allowing air to also enter the porous element through branch 22*b* of the gas delivery tube 21 and inlet 19 and pass through the porous portion of the wall thereof to mix with the foamable liquid passing through orifice 9 and over the outer surface of the porous portion 5 of the porous element 7 thereby producing foam for discharge through port 8.

However, in the event only dispensing of liquid is desired valve 20*a* is closed. Then pressurized air is supplied only to the foamable liquid in container 11 through branch 22*a* of delivery tube 21 whereby said liquid is tranferred to the foam producing means through conduit 12 and liquid inlet 6 and is discharged therefrom through discharge port 8 as a liquid.

Upon release of pressure within the foam dispensing device, i.e., upon cessation of dispensing of either foam or liquid, air is returned to the pressurized air source through valve 30 and the pressure in the foam dispensing device having been decreased valve 14 opens permitting liquid to enter the inner container 11 from the outer container 10 through port 15 until the liquid levels within said containers 10 and 11 and conduit 12 are equalized. Of course, other means, known to the art, may be used to return air to the pressurized air source and equalize the pressure within the system.

In the embodiment shown foamable liquid is initially present in containers 10 and 11 and tube 12 to the same height. When it is desired to dispense foam or liquid pressurized air, from a pressurized air source (not shown) enters outer container 11 through tube 21, branch 22*a* and gas inlet 17. The pressurized air causes the valve 14 to close thereby preventing any backflow from the inner container 11 to the outer container 10 through port 15. The pressurized air causes foamable liquid to rise through tube 12 and be delivered to the foam producing means 2 through inlet tube 6. The liquid then passes over the porous element 7, through orifice 9, and mixes with air passing through the pores thereof to form foam said foam then being discharged through exit port 8.

The pressurized air required for foam production is delivered into the porous element 7, through the pores of which it passes to mix the foamable liquid to form the foam, through branch 22*b* of delivery tube 21 and inlet tube 19 which are brought into fluid connection through valve 2*a* which is open.

During delivery of pressurized air to the foam dispensing device one-way valve 30 is closed due to the pressurized air forcing ball 25 against seat 24. After dispensing of the foam, the pressurized air delivery is terminated whence the pressure in the system drops. Valve 30 opens to allow atmospheric air to enter the system and valve 14 opens to allow foamable liquid to enter container 11 and tube 12 from container 10.

When it is desired to dispense liquid the above steps and effects are repeated except that valve 20*a* is maintained in a closed condition thereby preventing entrance of air into the porous element 7 and therethrough to mix with the foamable liquid. Then, the liquid delivered to the foam producing means through inlet tube 6 passes over the porous element 7 and, lacking air to mix with to form foam, is discharged through port 8 as a liquid.

In a modification of the above embodiment of the foam dispensing device the two-way valve 20*a* for controlling gas flow to the inner container 11 and, if desired to the foam producing means is replaced by a three-way valve 20*b*, as shown in FIG. 6, situated at the branching point of tube 21 and branches 22*a* and 22*b*. In this embodiment the valve 20*b* is opened only to branch 22*a* (FIG. 6(*b*)) if dispensing of liquid is desired or to both branches 22*a* and 22*b* (as shown in FIG. 6(*a*)) if it is desired to dispense foam.

The invention having been described with reference to specific embodiments thereof it is to be understood that variations and modifications may be made therein without departing from the scope of the invention.

I claim:

1. A foam generating article, for use in foam dispensing articles, for production of foams from foamable liquids and pressurized gases, supplied thereto from external sources, said article comprising:

(a) a housing comprising:

(1) a first hollow chamber surrounded by;

(i) a large opening at one end comprising a first discharge port for said foam;

(ii) at the opposite end an upper wall comprising gas inlet means, in fluid connection with the external pressurized gas source; and (iii) a first annular side wall descending from the edge of said upper wall comprising liquid inlet means in fluid connection with the external foamable liquid source;

(b) a partially porous element comprising a second hollow chamber within said first hollow chamber and spaced from the side walls thereof and in fluid connection with said gas inlet means to receive gas passed thereto from its source through said gas inlet means, said second hollow chamber being defined by;

(1) a large top opening through which the gas passed through the gas inlet means enters the second hollow chamber;

(2) a closed non-gas permeable end opposite said opening; and (3) a partially porous second side wall separating said opening and closed end, the top of said side wall being in sealable contact with the upper wall of the housing and spaced between said gas inlet means and the side wall of the housing;

wherein the portion of said side wall adjacent said non-gas permeable end is also non-gas permeable; and (c) a mixing chamber comprising a third hollow chamber comprising the space defined by the housing upper wall, the portions of the first side wall and the wall of the porous element, between the liquid inlet means and the bottom opening of the housing, and the bottom opening of the housing, wherein the foamable liquid, entering the first hollow chamber through the liquid inlet means, and gas, diffusing from the hollow chamber of the porous element into the mixing chamber, mix to form the foam which is discharged through said discharge port.

2. The article of claim 1 wherein said mixing chamber is tapered, the distance between said gas permeable wall and the side wall of said housing increasing with increasing distance from the liquid inlet means towards said first discharge port.

3. The article of claim 2 wherein the portion of the gas permeable wall between the liquid inlet means and the first discharge port is tapered.

4. The article of claim 2 wherein the portion of the side wall of the housing between the liquid inlet means and the first discharge port is tapered.

5. The article of claim 1 wherein the portion of the side wall of the housing and the portion of the gas permeable wall between the liquid inlet means and the first discharge port are approximately parallel.

6. The foam generating article of claim 1 wherein (a) the upper wall of said housing comprises
  (i) an upper portion;
  (ii) a lower portion spaced therefrom;
  (iii) a side portion separating said upper and lower portions wherein said side, upper and lower portions define a fourth hollow chamber comprising a liquid distribution plenum;

(b) the gas inlet means comprises a first gas entry port, spaced inwardly from said side portion, through said upper and lower portions and sealed from said liquid distribution plenum, in fluid connection with said pressurized gas supply means and the hollow chamber of the gas permeable element; and (c) the liquid inlet means comprises
  (i) a first liquid entry port in fluid connection with said liquid distribution plenum and said foamable liquid source; and
  (ii) at least one opening in the lower portion of said upper wall, spaced outwardly from said porous element, in fluid connection with said liquid distribution plenum and said first hollow chamber to permit passage of liquid from said liquid distribution plenum to the mixing chamber.

7. The article of claim 1 wherein the top wall portion of the side wall of said gas permeable element comprises a gas impermeable wedge shape tapered downward from the contact of said side wall with the lower surface of the upper wall of the housing towards the side wall of said housing creating a small annular opening, or orifice, between the lower end of the wedge shape wall portion of the gas permeable element side wall and said housing side wall, for the passage of foamable liquids therethrough into said mixing chamber wherein said liquid interacts with the gas diffusing through the permeable portion of the gas permeable element to form said foam, said wedge shaped portion receiving liquid passing through the opening in said lower portion to direct said liquid to said orifice.

8. The article of claim 1 wherein said source of foamable liquids comprises a large first container comprising a second discharge port closed by a cap comprising:

(a) a gas inlet port therethrough from which vertically rises a gas inlet tube in fluid connection with said pressurized gas source;

(b) a liquid outlet port therethrough from which vertically rises a liquid outlet tube in liquid connection with the foam producing article and the inner container;

(c) a tubular element inwardly spaced from the wall of said large first container and descending vertically from the bottom wall of said cap said tube defining an inner second container within said first container said tube comprising at its lower end a port for liquid connection with said first container for closing of said port when the pressure within said second container is greater than within the first container; and (d) a small third tube, within said second container, descending vertically from the bottom of and said cap spaced inwardly from the wall of said inner container and outwardly from the liquid outlet port and defining a liquid conduit in liquid connection at its upper end with the liquid outlet means and having an opening in its lower end for liquid connection with said second container.

9. The article of claim 8 wherein said pressurized gas supply means comprises (a) a pressurized gas source; and (b) a connecting tube in fluid connection with said source and the gas inlet means of the foam generating article.

10. The article of claim 9 wherein said connecting tube comprises at least two branches wherein (1) a first branch is in fluid connection with the gas inlet tube of the liquid delivery means; and (2) a second branch is in fluid connection with the gas inlet means of the foam producing article through said first gas inlet means.

11. The article of claim 10 comprising two-way valve means in said second branch, downstream of the branching point wherein when said valve means is (a) open gas will enter the porous element and foam will be discharged; and (b) closed gas will not enter the porous element and the foamable liquid will be discharged.

12. The article of claim 10 comprising three-way valve means at the branching point, to connect said gas supply means to said foam generating article and liquid supply means wherein when said valve means is;

(1) open to the first container and the inlet means of the porous element foam is discharged through the first discharge port of the foam generating article; and (2) open to the first container and closed to the inlet means of the porous element foamable liquid is discharged through the first discharge port of the foam generating article.

13. The article of claim 1 further comprising (a) first connecting means in fluid connection with said gas inlet means and said gas source to transport the gas from the source to the gas inlet means; and (b) second connecting means in fluid connection with said liquid inlet means and said foamable liquid source to transport the liquid from the source to the liquid inlet means.

14. An article for the alternative dispensing of foamable liquids and foams generated therefrom said article comprising:

(a) a foam generating article, for use in foam dispensing articles, for production of foams from foamable liquids and pressurized gases, supplied thereto from external sources, said article comprising:
  (1) a housing comprising:
    (i) a first hollow chamber surrounded by;
      (a) a large opening at one end comprising a first discharge port for said foam;
      (b) at the opposite end an upper wall comprising gas inlet means, in fluid connection with the external pressurized gas source; and
      (c) a first annular side wall descending from the edge of said upper wall comprising liquid inlet means in fluid connection with the external foamable liquid source;
  (2) a partially porous element comprising a second hollow chamber within said first hollow chamber and spaced from the side walls thereof and in fluid connection with said gas inlet means to receive gas passed thereto from its source through said gas inlet means said hollow chamber being defined by;

(i) a large top opening through which the gas passed through the gas inlet means enters the second hollow chamber;

(ii) a closed non-gas permeable end opposite said opening; and (iii) a partially porous second side wall separating said opening and closed end, the top of said side wall being in sealable contact with the upper wall of the housing and spaced between said gas inlet means and the side wall of the housing;

wherein the portion of said side wall adjacent said non-gas permeable end is also non-gas permeable; and (3) a mixing chamber comprising a third hollow chamber comprising the space defined by the housing upper wall, the portions of the first side wall and the wall of the porous element, between the liquid inlet means and the bottom opening of the housing, and the bottom opening of the housing, wherein the foamable liquid, entering the first hollow chamber through the liquid inlet means, and gas, diffusing from the hollow chamber of the porous element into the mixing chamber, mix to form the foam which is discharged through said discharge port;

(4) first connecting means in fluid connection with said gas inlet means and said gas source to transport the gas from the pressurized gas source to the gas inlet means of the foam generating article; and (5) second connecting means in fluid connection with said liquid inlet means and said foamable liquid source to transport the liquid from the source to the liquid inlet means of the foam generating article;

(b) a foamable liquids source comprising (1) a large first container comprising a discharge port closed by a cap comprising:

(i) a gas inlet port therethrough from which vertically rises a gas inlet tube in fluid connection with said pressurized gas source;

(ii) a liquid outlet port therethrough from which vertically rises a liquid outlet tube in liquid connection with the foam producing article and the inner container;

(iii) a tubular element inwardly spaced from the wall of said large first container and descending vertically from the bottom wall of said cap said tube defining an inner second container within said first container said tube comprising at its lower end a port for liquid connection with said first container and a one-way valve for closing of said liquid connection port when the pressure within said second container is greater than within the first container; and (iv) a small third tube, within said second container, descending vertically from the bottom of and said cap spaced inwardly from the wall of said inner container and outwardly from the liquid outlet port and defining a liquid conduit in liquid connection at its upper end with the liquid outlet means and having an opening in its lower end for liquid connection with said second container;

(c) pressurized gas supply means comprising (1) a pressurized gas source; and (2) a connecting tube in fluid connection with said source comprising at least two branches wherein (i) a first branch is in fluid connection with the gas inlet tube of the first container of the liquid delivery means; and (ii) a second branch is in fluid connection with the gas inlet means of the foam generating article.

* * * * *